US006560793B2

(12) United States Patent
Walker

(10) Patent No.: US 6,560,793 B2
(45) Date of Patent: May 13, 2003

(54) SINGLE ATTENDANT PATIENT REPOSITIONING AND CARE DEVICE

(76) Inventor: Lucinda B. Walker, 9680 Cumberland Rd., Pleasant City, OH (US) 43772

( * ) Notice: Subject to any disclaimer, the term of this patent is extended or adjusted under 35 U.S.C. 154(b) by 0 days.

(21) Appl. No.: 09/896,498

(22) Filed: Jun. 29, 2001

(65) Prior Publication Data

US 2002/0029417 A1 Mar. 14, 2002

Related U.S. Application Data

(63) Continuation-in-part of application No. 09/515,443, filed on Feb. 29, 2000, now abandoned.
(60) Provisional application No. 60/152,944, filed on Sep. 9, 1999.

(51) Int. Cl.[7] ..... A61G 7/10; A61G 7/14; A61G 1/01
(52) U.S. Cl. ..... 5/81.1 T; 5/926; 5/922
(58) Field of Search ..... 5/81.1 T, 81.1 R, 5/81.1 HS, 926, 922

(56) References Cited

U.S. PATENT DOCUMENTS

| | | | | |
|---|---|---|---|---|
| 3,829,914 A | 8/1974 | Treat | 5/81 R |
| 4,180,879 A | 1/1980 | Mann | 5/508 |
| 4,908,889 A | 3/1990 | Lonardo | 5/81 R |
| 5,274,862 A | 1/1994 | Palmer, Jr. et al. | 5/81.1 |
| 5,530,974 A | 7/1996 | Rains et al. | 5/81.1 T |
| 5,608,929 A | 3/1997 | Crane | 5/81.1 R |
| 5,920,929 A | 7/1999 | Hensley et al. | 5/81.1 T |
| 6,073,279 A | 6/2000 | Skaler | 5/81.1 T |

*Primary Examiner*—Alexander Grosz
(74) *Attorney, Agent, or Firm*—Sheridan Ross P.C.

(57) ABSTRACT

A draw sheet with low friction underside surface and removable sturdy body straps attached to draw sheet upper surface by means of reusable fasteners to be positioned under a patient in a convalescent bed. A grip dowel positioned through opposing side sleeves of the draw sheet to allow one-handed turning of a patient by a care giver. The body straps secure the patient in a side rest position by attachment to the side rails of the bed. The draw sheet is detachable from the body straps to reveal the torso of the side rest secured patient. Body strap ends stays may be individually disengaged from the bed rails and to obtain greater access to the upper or lower torso of the patient. If so capable, the patient may disengage the body straps from the bed rails to return to a back rest position. Additionally, grip dowels positioned in pull strap sleeves flanking the patient's head and neck may be used to longitudinally position the patient in bed.

24 Claims, 8 Drawing Sheets

SINGLE ATTENDANT PATIENT REPOSITIONING AND CARE DEVICE

CROSS-REFERENCE TO RELATED APPLICATION

The present application is a continuation-in-part of U.S. patent application Ser. No. 09/515,443 filed Feb. 29, 2000 now abandoned, entitled "Single Attendant Strap and Cushion Patient Repositioning and Care Method," which, in turn, claims priority from Provisional Patent Application Serial No. 60/152,944 having the same title, filed Sep. 9, 1999. Both applications are incorporated herein by reference in their entirety.

FIELD OF THE INVENTION

The invention relates to a patient draw sheet that facilitates positioning of a patient to further facilitate medical treatment and patient care. More particularly, the invention relates to a draw sheet which maintains side positioning of a patient, thereby permitting a single care provider to attend to patient needs. It further allows a single care provider to reposition a patient both laterally and longitudinally relative to a bed or similar patient support apparatus. The invention may further include adjustable cushions to maintain patient positioning and alignment during active use of the draw sheet for patient comfort as well as to facilitate use of the draw sheet.

BACKGROUND OF THE INVENTION

Health-care workers at hospitals, nursing homes, and in home care situations increasingly face shortages of personnel due to both a tight labor market and restrictive managed care contracts. Nevertheless, the needs of the patients remain. Patients routinely and regularly must be repositioned in order to perform medical and personal care tasks, to prevent pressure sores, and simply to provide for comfort for the individual. There is a constant need for a single care provider to provide quality care without causing disabling back strain to the care provider, particularly the elderly home-care giver, such as a spouse or parent.

For example, regular movement of invalid, bedfast patients prevents bed sores from occurring. Turning a patient from a back rest position to a side rest position and vice versa maintains continuous circulation to pressure points on the body, thereby reducing the occurrence of bed sores. Indeed, to achieve optimal circulatory benefit, the patient needs both his or her upper and lower torso free of any contact with cloth fabric. Patients also need to be laterally repositioned from back rest to side rest position and vice versa to permit inspection and treatment of incisions and/or injuries, to allow for bathing, and to allow for the removal and replacement of bedding.

In addition to laterally repositioning a patient in a bed, patients have a tendency to migrate longitudinally on the bed surface from the head of the bed towards the foot of the bed, particularly when the head is elevated. It is common for such a patient to need to be repositioned up to 16 times in a 24 hour period. The task of longitudinally repositioning a patient is also extremely difficult and cumbersome for a single care provider.

It is believed that fifty to sixty percent of all care giver injuries are directly related to patient repositioning tasks. Back injuries are the most common complaint of the care giver. Often two care givers are required to perform the patient positioning task. Unfortunately, because of the lack of a second care provider, many patients are not moved as often as needed and patient care suffers as a result.

Existing prior art addresses some of the needs of bedridden patients, but does not satisfy all needs. For example, many draw sheets allow a patient to be repositioned from a back rest position to a side rest position, and vice versa. Some draw sheets further include fixed straps in order that a single care giver can accomplish the repositioning. However, Applicant is not aware of any prior art device in which the draw sheet is detachable from the body straps to allow access to the patient's body while simultaneously maintaining the patient in a side rest position; one in which the patient can release the side straps from the bed rails; one which includes means for longitudinally repositioning a patient; and, in which all of these functions can be performed by a single care giver.

An object of this invention is to provide a means and method of positioning patients by a single care giver in a manner that will prevent injury to the care giver and does no harm to the patient.

Another object of this invention is to comfortably retain the turned patient in a side rest position while the care giver has two free hands to attend to patient needs, and to further allow complete access to the side rest retained patient's torso.

Another object of this invention is to permit a side positioned patient the freedom and flexibility, if they are capable, to easily remove themselves from the retention device of this invention.

A further object of this invention is to allow a single care giver to longitudinally reposition a patient.

These and other objects of the present invention will be apparent to those skilled in the art upon reading the specification, including the appended claims, and upon reference to the accompanying drawings.

BRIEF DESCRIPTION OF THE DRAWINGS

For a more complete understanding of this invention, reference should now be made to the embodiment illustrated in greater detail in the accompanying drawings and described below by way of example.

Figure 1:
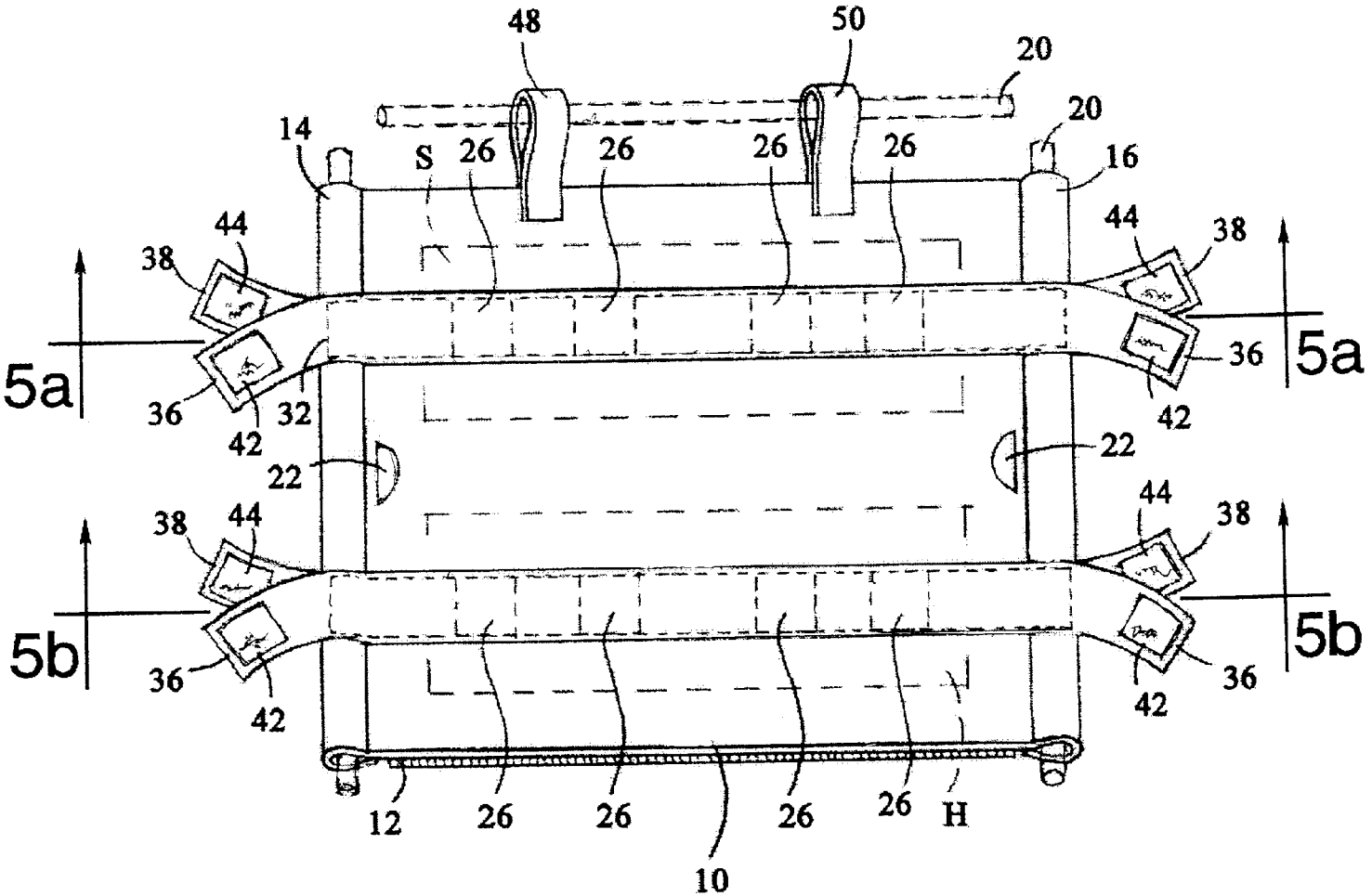
FIG. 1 is a top perspective view of the preferred embodiment of the draw sheet and removable body straps of the present invention.

It should be appreciated that the drawings are for illustration purposes only and are not necessarily to scale. In certain instances, details which are not necessary for an understanding of the present invention or which render other details difficult to perceive, may have been omitted. It should also be understood that the invention is not limited to the embodiment illustrated.

SUMMARY OF THE INVENTION

The preferred embodiment of the present invention is distinguished from the prior art by providing for the disengagement of the body sheet while sustaining the patient in the side rest position by using a body sheet or draw sheet in combination with two detachable body straps. The straps may be secured to and removed from the draw sheet by any number of acceptable means, including buttons, snaps and fasteners, although mating strips of hook and loop material, such as Velcro®, is the preferred method. Grip dowels positioned in sleeves along the side of the draw sheet allow, with one hand, rotation of patient by a care giver. Removable body straps secure the patient in a side rest position to bed rails by means of end mating strips. The draw sheet may then be detached from the body straps to reveal the back side of the patient for treatment, cleaning and/or care. In addition, the end mating strips or body strap stays may be individually disengaged from a bed rail to allow total access to the patient's upper or lower torso while maintaining the patient secured in a side rest position. Importantly, the patient has the freedom to easily disengage the body strap stays from the bed rails to return to a back rest position.

In use, the preferred embodiment of the draw sheet with attached removable body straps is arranged horizontally under the torso of a patient in convalescent bed. Sturdy fabric-like pull strap sleeves flank a patient's head and neck and the lateral side edges of the draw sheet. A removable grip dowel is threaded through the draw sheet side sleeves to allow for lateral positioning or rolling of the patient on the bed. Reaching over the patient, a care giver grasps the grip dowel and pulls the draw sheet over the patient, engaging the back of the patient's torso in a turning motion to reposition the patient in a side rest position. The mating strips or stays positioned at the ends of the body straps are then secured around the bed rail to maintain the patient in a side rest position. For longitudinal repositioning on the bed, the removable grip dowel is threaded through pull strap sleeve openings adjacent the patient's head and neck. The care giver leans over the head of the bed, grasps the grip dowel and applies pulling pressure. Ideally, the underside of the draw sheet is made of a slick, low friction material to facilitate longitudinal movement of the patient. The device of the invention, with exclusion of the grip dowel, is machine washable. The present invention is for use with conscious, sleeping or comatose patients.

Further, the invention may also utilize an adjustable stack of cushions to separate patient legs to maintain proper hip/knee alignment while resting or while being moved. The use of the cushions will also ease the task of washing and drying the patient's legs.

DETAILED DESCRIPTION OF THE PREFERRED EMBODIMENT

Figure 2:
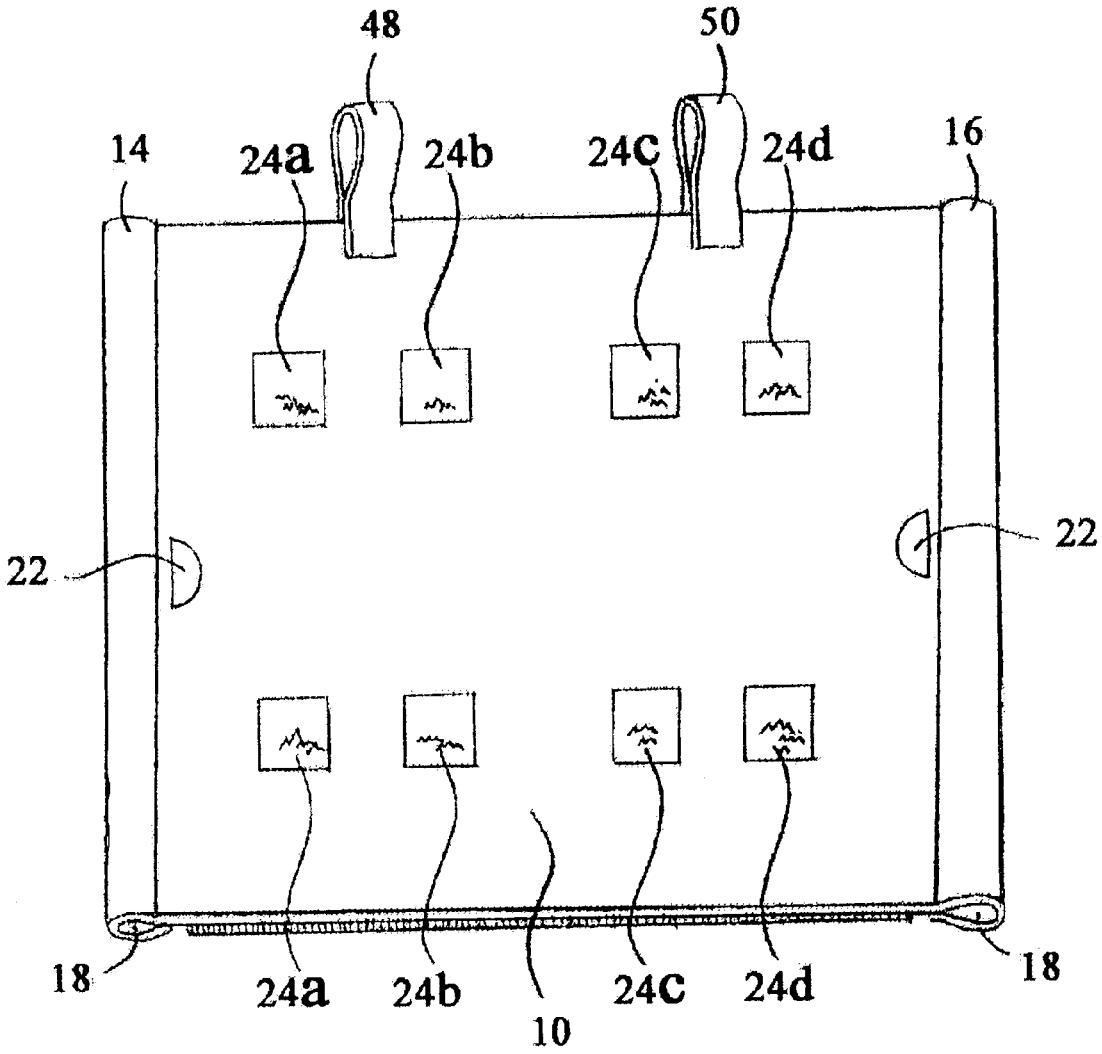
FIG. 2 is a top perspective view of the draw sheet shown in FIG. 1, with the straps removed.

FIGS. 1 and 2 show a draw sheet 10 of sturdy fabric like material, rectangular in dimension, made in accordance with the teachings of the present invention. Because of its intended use, the draw sheet fabric should be strong, durable and washable. Examples of acceptable fabric include, but are not limited to, trigger (a blended fabric of 65% polyester and 35% cotton) or heavy cotton and the like. In the preferred embodiment, it is intended that the draw sheet 10 be several inches greater in length than the patient's torso and have a width sufficient to entirely encircle the patient's torso. However, it is acceptable that the width of the draw sheet be at least approximately one-half the circumference of the patient's torso. In addition, it is preferred that the bottom surface 12 of the draw sheet comprise a low friction material, such as silk, polyester, polypropylene, satin, nylon or Gore-Tex®. Such material could have the same dimension as the draw sheet 10 and be permanently attached, such as by sewing, to the under surface of the draw sheet. Left and right laterally positioned sleeve(s) 14, 16, respectively, are formed along the side edge of the draw sheet 10 and have openings 18, at the upper and lower ends to accommodate placement of a grip dowel 20. As should be appreciated by those skilled in the art, the sleeves 14, 16 may be formed by folding the draw sheet back on itself, or by other known methods. Also, while the figures illustrate a single sleeve extending the length of the draw sheet, it should be understood that the sleeves may be shorter in length or multiple spaced sleeves may be utilized with gaps between consecutive sleeves forming an opening for gripping the dowel. However, in the preferred embodiment, semi-circular openings 22, having dimension and a size to allow a four-finger grasp by care giver for one-handed turning of a patient, are provided adjacent the sleeves 14, 16 and approximately mid-way along the length of the sleeves. Ideally, the openings 22 are equal distance from the draw sheet shoulder area (generally indicated by the region identified by reference numeral S in FIG. 1) and the draw sheet hip area (generally indicated by the region identified by reference numeral H in FIG. 1).

Figure 3:
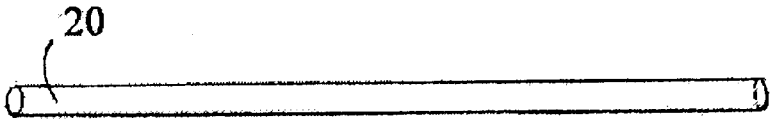
FIG. 3 is a planar view of a grip dowel used in combination with the present invention.

In FIG. 3, grip dowel 20 is shown. The grip dowel 20 may be made of wood, or any other lightweight rigid material such as aluminum or plastic. Grip dowel 20 is of approximately a length equal to or greater than length of draw sheet sleeves 14, 16. The diameter of the grip dowel is preferably not greater than 2 inches.

As shown in FIGS. 1 and 2, a series of fasteners 24 are affixed to the upper surface of the draw sheet 10 across the draw sheet shoulder area S and draw sheet hip area H. A complementary set of fasteners 26 is affixed to body straps 28 to connect the body straps to the draw sheet. In the preferred embodiment, the fasteners 24, 26 are Velcro®. More specifically, the fasteners 24 comprise a plurality of permanently stitched, substantially square hook material

Figure 4:
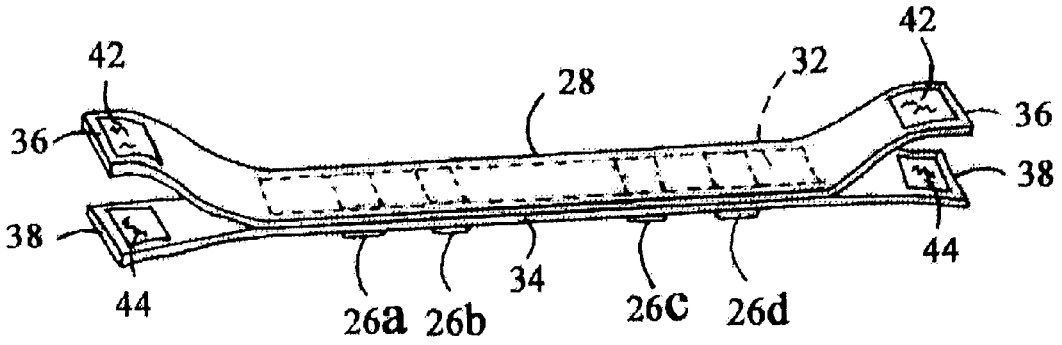
FIG. 4 is a side perspective view of the preferred embodiment of a removable body strap of the present invention.
Figure 5A:
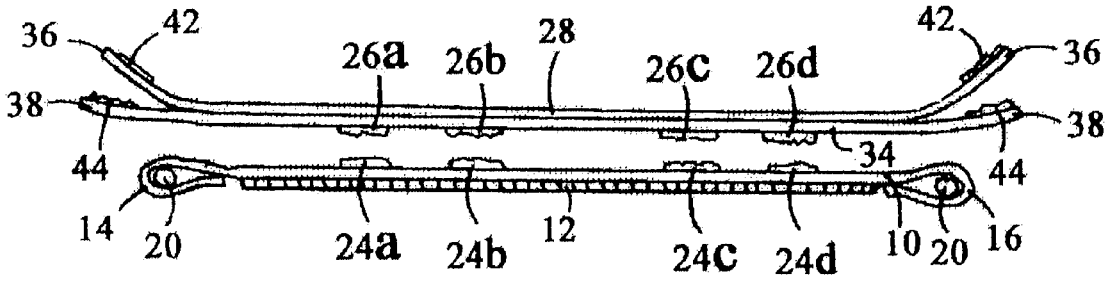
FIG. 5*a* is a cross-sectional view of the draw sheet and removable body strap taken along line 5A—5A of FIG. 1.
Figure 5B:
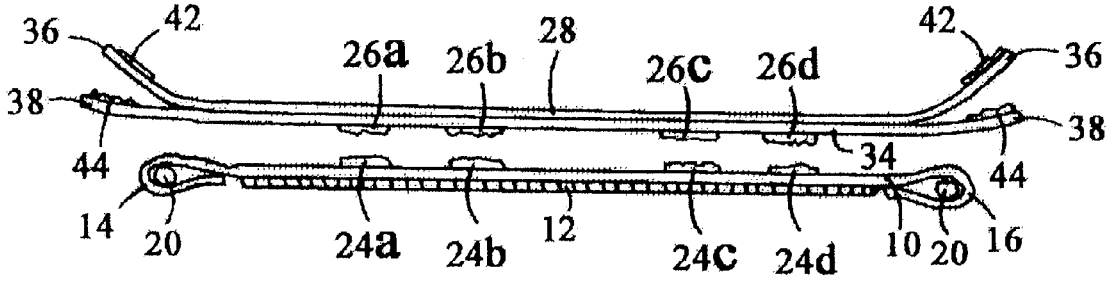
FIG. 5*b* is a cross-sectional view of the draw sheet and removable body strap taken along line 5B—5B of FIG. 1.

24*a,* 24*b,* 24*c,* 24*d,* aligned for mating with complementary squares of loop material 26*a,* 26*b,* 26*c,* 26*d,* affixed to body straps 28 (see FIGS. 4, 5*a* and 5*b*).

In FIG. 4, two layers of sturdy fabric-like material form a removable body strap 28, which is rectangular in dimension with length greater than width and has a width greater than its thickness. The material forming the body strap 28 is stitched together around the perimeter of region 32*a* (shown in phantom) to provide strength. The lower surface 34 has, in permanently stitched placement, a plurality of square in dimension loop tabs 26*a,* 26*b,* 26*c,* 26*d* aligned for mating with hook members 24*a,* 24*b,* 24*c,* 24*d* disposed on the draw sheet 10.

FIG. 5*a* illustrates the body strap 28 aligned for mating with a draw sheet 10 in the shoulder area S, as shown in FIG. 1. Similarly, FIG. 5*b* illustrates the body strap 28 aligned for mating with a draw sheet 10 in the hip area H of FIG. 1. In each instance, one set of fasteners 24 on the draw sheet mates with a complementary set of fasteners 26 on the body strap. In the preferred embodiment, hook material 24*a*–24*d* mates with loop material 26*a*–26*d,* respectively. While four sets of mating fasteners are illustrated, it should be understood that more or less fasteners could be utilized, depending upon the nature of the fastener and the dimension of the draw sheet, body strap and fasteners. It should also be appreciated that the fasteners need not be hook and loop material, but also could be snaps, buttons or any other type of connector which would facilitate removable attachment of the body straps to the draw sheet without compromising patient comfort and/or care.

As shown in FIGS. 1, 4, 5*a* and 5*b,* the distal ends of the body straps 28 terminate in a pair of overlapping rail straps 36, 38. As illustrated, the upper surface of each rail strap includes a complementary fastener 40 and 42, respectively, such as a section of hook or loop material, affixed to the rail straps 36, 38. The rail straps are designed to overlap and attach around the side rails 44 of a convalescent bed 46.

Figure 6:
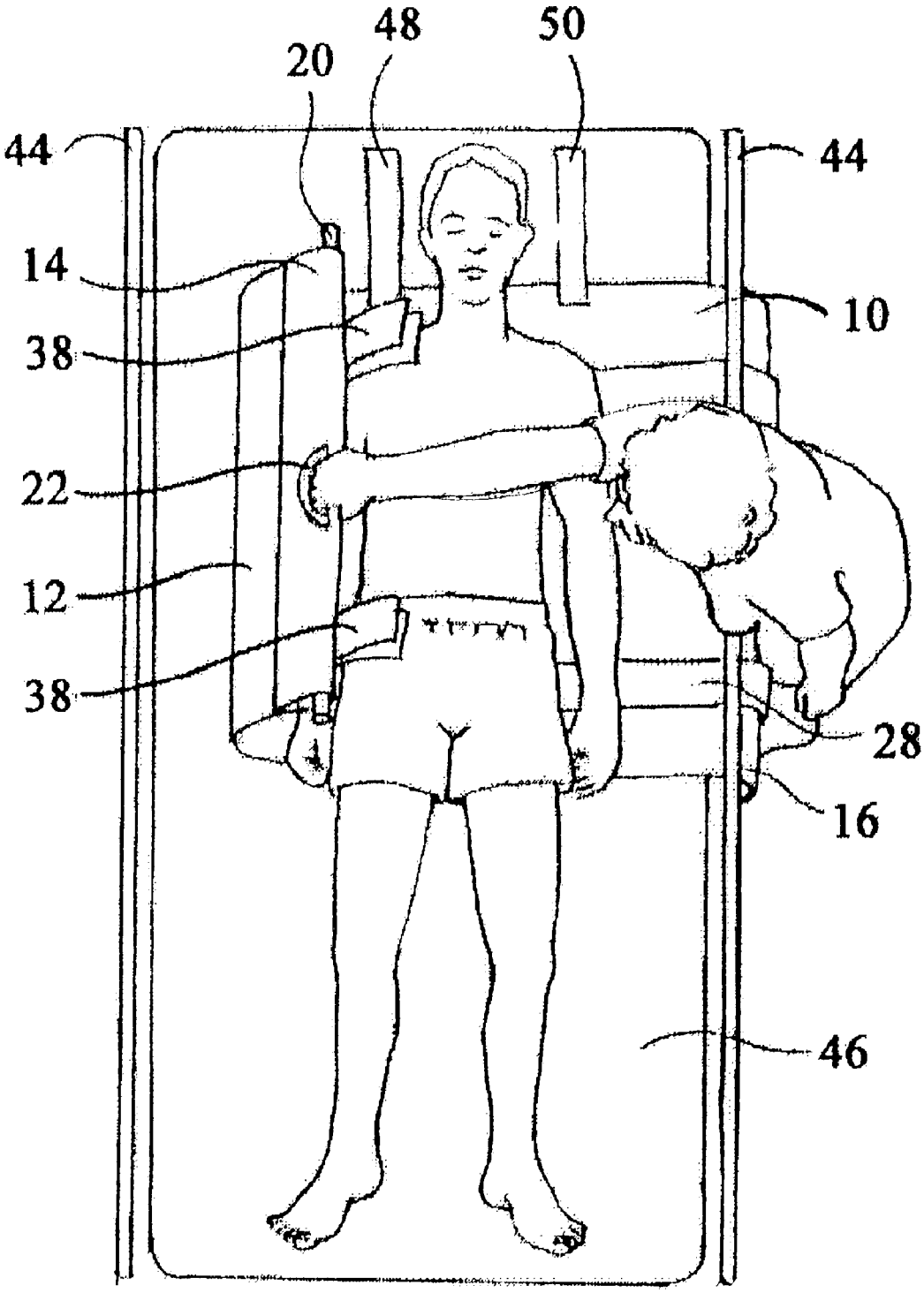
FIG. 6 is a top planar view of a hospital bed with a care giver turning a patient from a back rest position using the preferred embodiment of the present invention.

Referring to FIG. 6, to turn a patient, a grip dowel 20 is threaded through the sleeve 14. A care giver reaches over the patient and with one hand grasps the dowel grip 20 and sleeve 14 through opening 22. By applying pulling pressure, the draw sheet 10 engages the back torso of the patient in a turning motion and transfers the patient to a side rest position.

Figure 7:
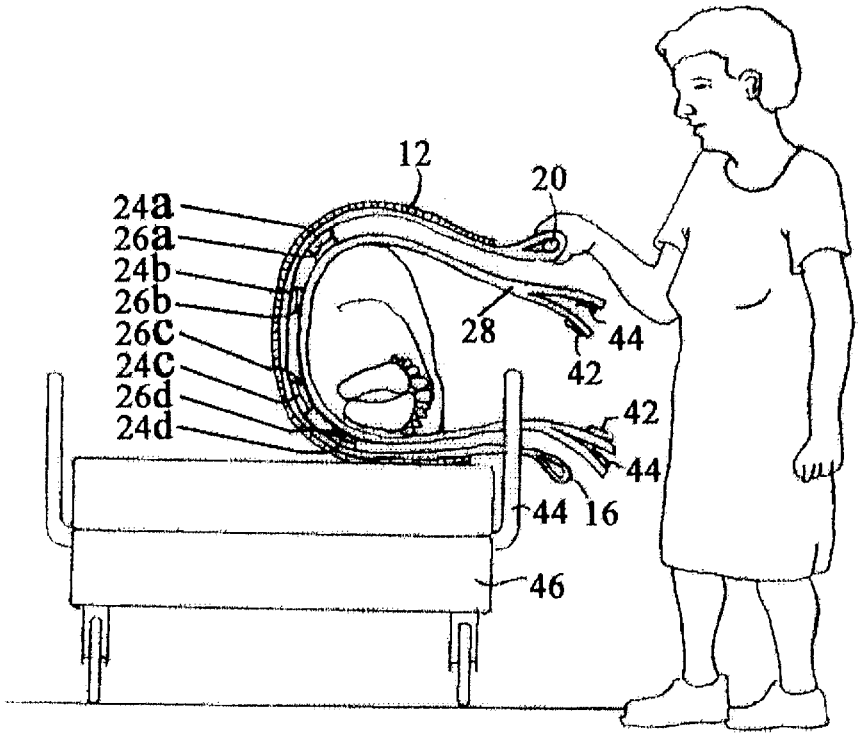
FIG. 7 is an end view of the bed and patient shown in FIG. 6, with the care giver turning the patient from a back rest to side rest position using the preferred embodiment of the present invention.

Once the patient is in a side rest position, as shown in FIG. 7, the care giver maintains grasp of the sleeve 14 and dowel grip 20 with one hand, and the free hand is available to secure either or both pairs of end mating strips 36, 38 around side rail 44 by attaching complementary fasteners 42, 44. (See FIG. 8.) It should be appreciated that more than two body straps 28 may be utilized. Also, one of skill in the art will appreciate that different types of fasteners may be utilized, such as snaps, ties or the like.

Figure 8:
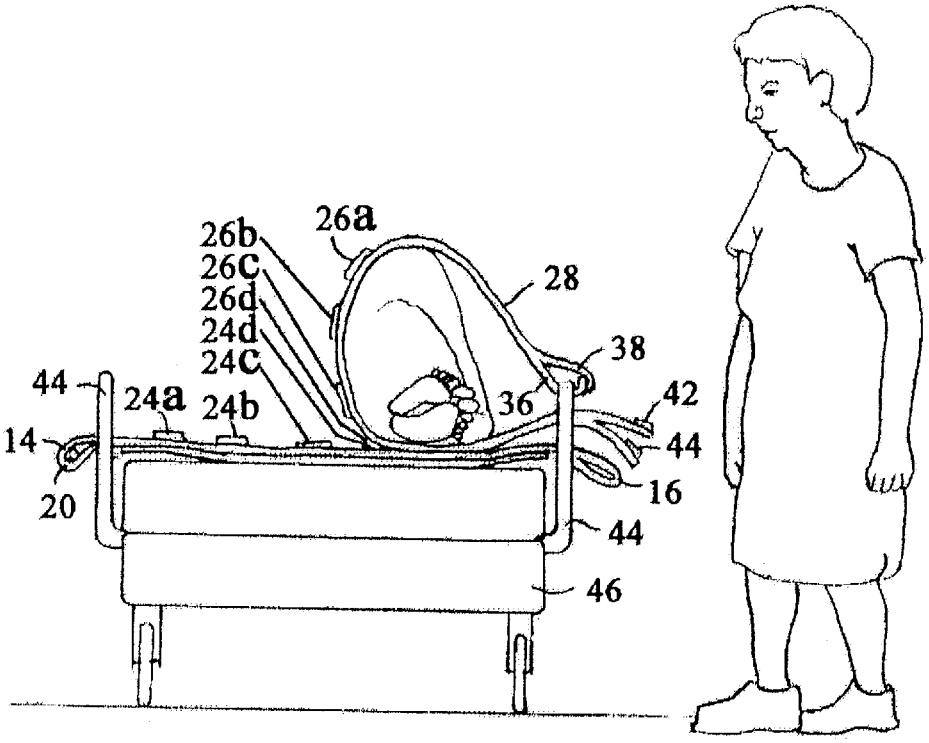
FIG. 8 is an end view of the bed and patient shown in FIG. 7, but further showing removable body straps secured to the bed rail and the draw sheet disengaged from the patient.
Figure 9:
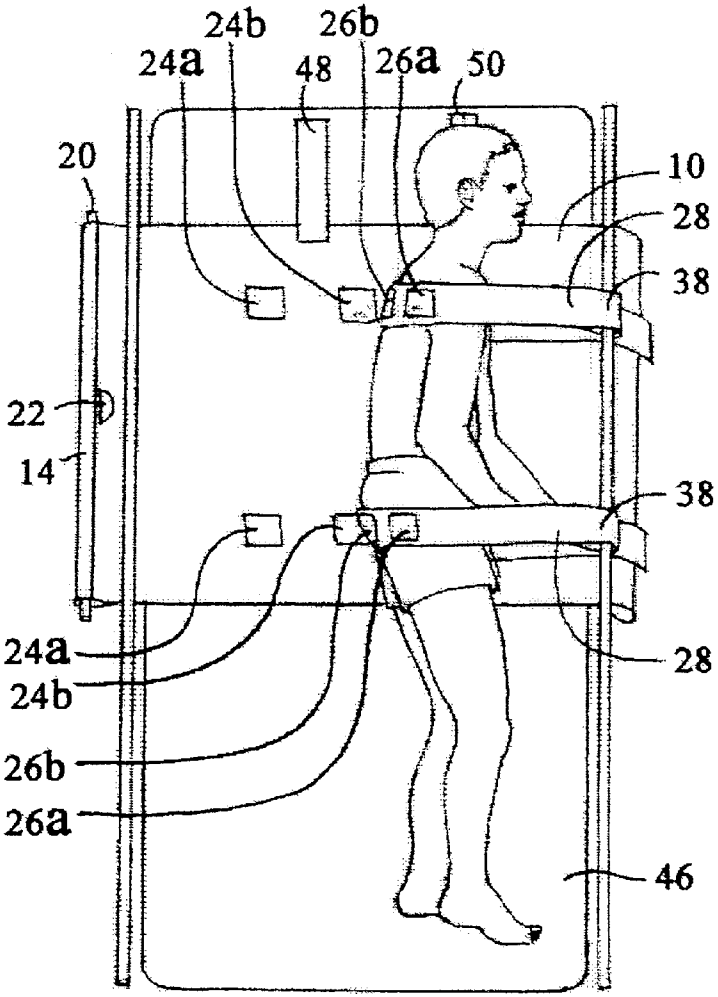
FIG. 9 is a top planar view of a hospital bed with a patient in a side rest position by removable body straps, with the draw sheet disengaged from the patient.

FIGS. 8 and 9 show the draw sheet 10 separated from both body straps 28. As a result, the draw sheet is repositioned back to its pre-turn position on convalescent bed 46. In this fashion, portions of the patient's torso are accessible for care and treatment. Both body straps 28 are secured to the bed rail 44 by end strips 36, 38. If the patient has use of his arms and hands, he will have the freedom and flexibility to detach the rail strips 36, 38 from the bed rail 44 and return to a back rest position.

Figure 10:
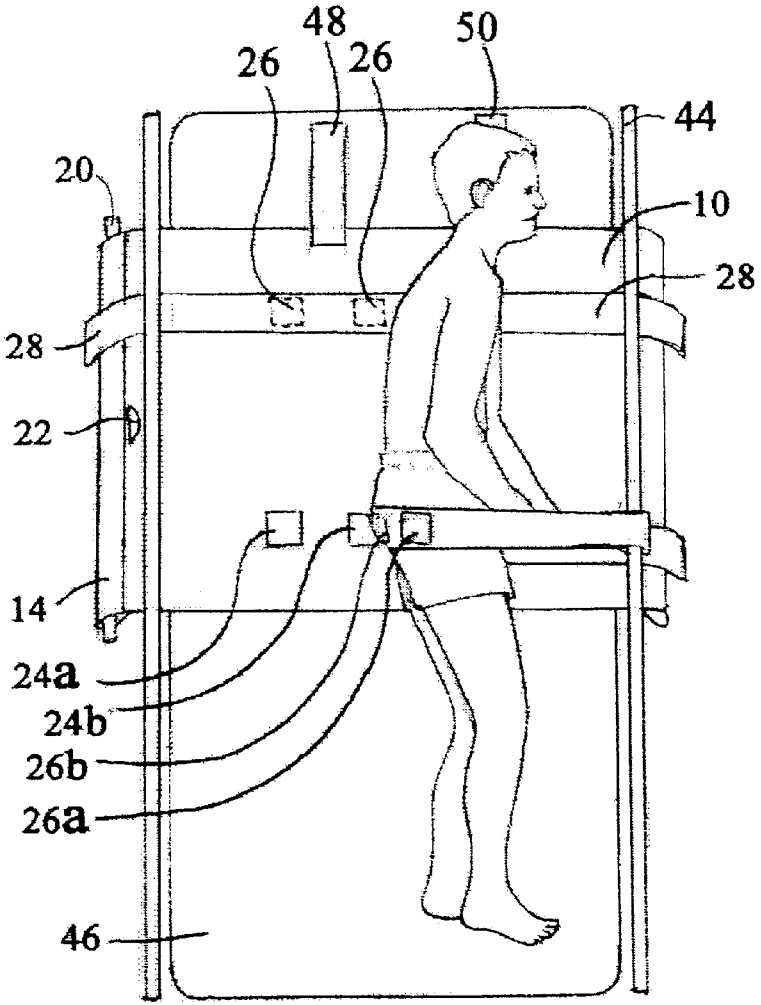
FIG. 10 is a top planar view of a hospital bed with a patient restrained in a side rest position by a hip body strap, further showing the shoulder area body strap and draw sheet removed.
Figure 11:
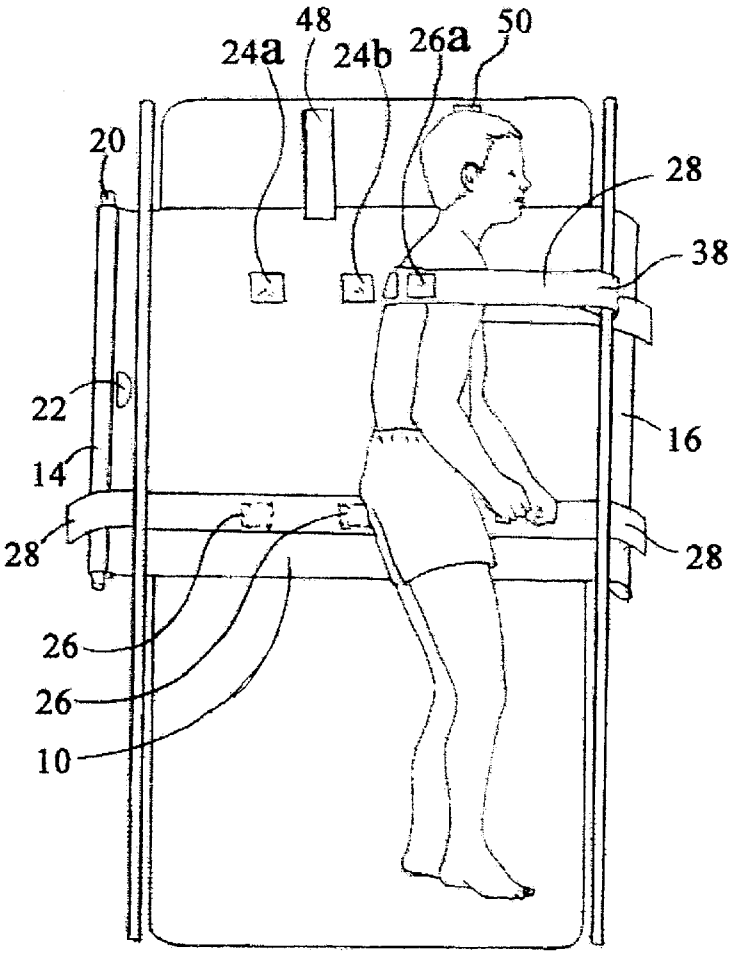
FIG. 11 is a top planar view of a hospital bed with a patient restrained by a removable shoulder body strap, further showing the hip area body strap and draw sheet removed.

Still greater access can be gained to the patient's torso, as seen in FIGS. 10 and 11. In FIG. 10, the patient is in left side rest position with the shoulder area body strap 28 detached from side rail 44 and reattached to the draw sheet 10. As a result, the entire upper torso of the patient is exposed for care, including washing and medicating, unlike the partially exposed alternative illustrated in FIGS. 8 and 9. Alternatively, in FIG. 11, the patient is in left side rest position with the hip area body strap 28 detached from the side rail 46 and reattached to the draw sheet 10. In this context, the lower torso region of the patient is exposed for patient care.

Although not shown in the drawings, it should be appreciated that the present invention will also function to reposition a patient from a back rest position to a right side rest position, and vice versa.

Figure 12:
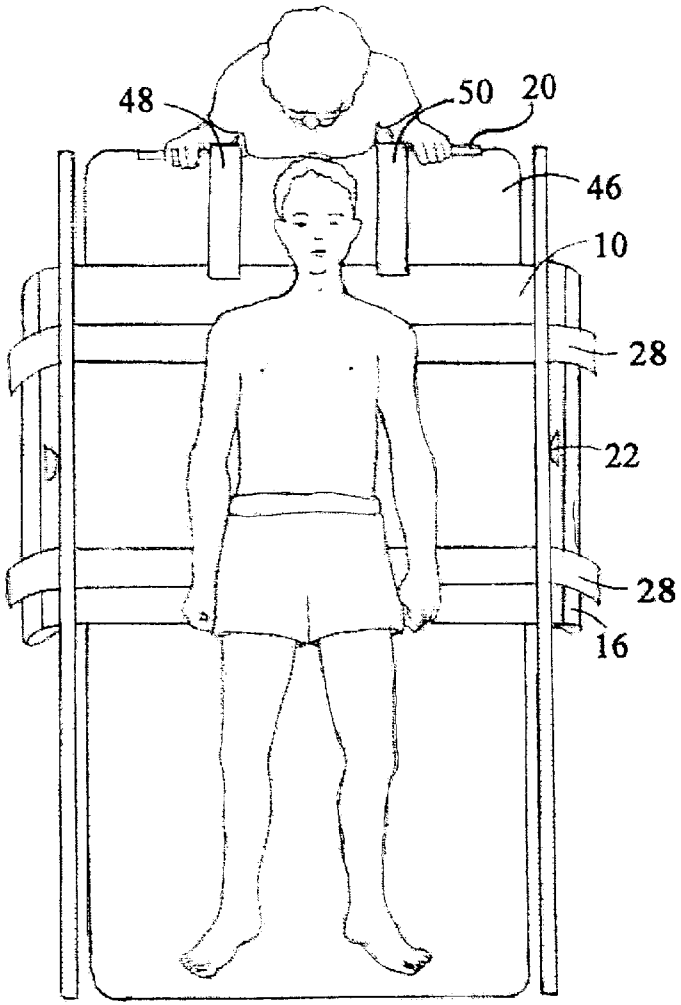
FIG. 12 is a top planar view of a hospital bed with a patient in back rest position on the preferred embodiment of the present invention, with a care provider in a longitudinal pull configuration.
Figure 13:
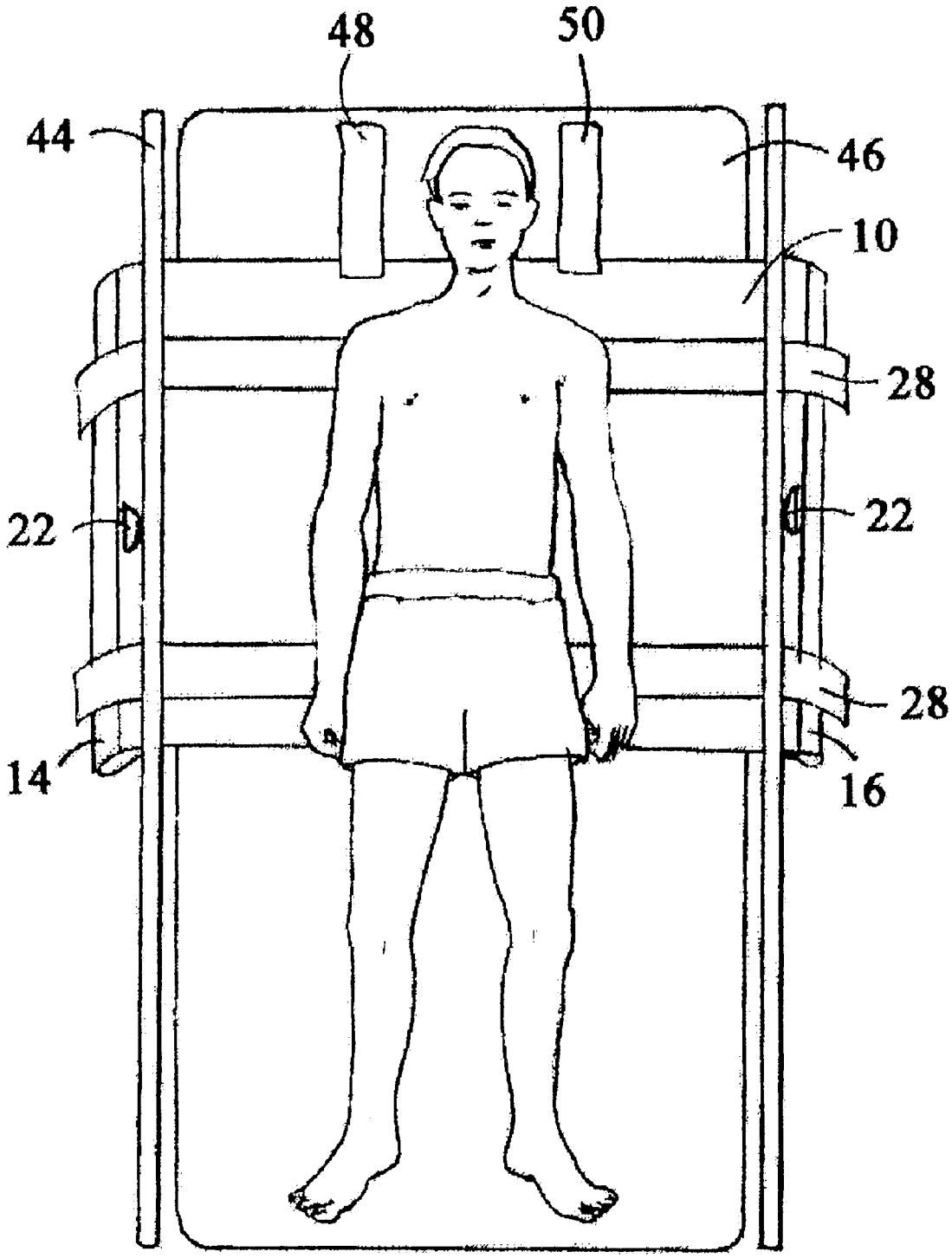
FIG. 13 is a top planar view of a hospital bed with a patient in a back rest position on the preferred embodiment of the present invention.

The draw sheet of the present invention can also be used to reposition the patient longitudinally in the bed. As seen in FIG. 13, the draw sheet 10 with removable body straps 28 is arranged on top surface of convalescent bed 46 and under a patient in a back rest position. Pull straps 48, 50 flank the right and left sides of the patient's head, respectively. Referring to FIG. 12, a grip dowel 20 is threaded through pull straps 48, 50. The care giver stands at the head of the bed, leans over and with two hands grasps the grip dowel 20 and exerts pulling pressure to longitudinally relocate the patient toward the head of the bed. Longitudinal repositioning is facilitated if the lower surface 12 of the draw sheet is a low friction material.

From the above description, it is apparent that the objectives of the present invention have been achieved. While only certain embodiments have been set forth, alternative embodiments and various modifications will be apparent to those skilled in the art from the above description. For example, the draw sheet need not be rectangular, but could be other shapes. Also, pull straps could be added to the bottom edge of the draw sheet to reposition the patient toward the foot of the bed, such as are shown in FIG. 13 in phantom as elements 52, 54. These and other alternatives are considered equivalents and within the spirit and scope of the present invention.

What is claimed is:

1. A draw sheet for turning a patient in a bed with side rails comprising:

a rectangle of sturdy fabric having a length that is greater than the length of a patient's torso and a width sufficient to encircle at least half the patient's torso;

a sleeve formed along the long edges of said fabric, said sleeve disposed at least at a position proximate the shoulder area and hip area of a patient's torso;

at least one opening in said draw sheet disposed proximate each said sleeve;

a plurality of pull straps extending outwardly from the short edge of said draw sheet proximate the head and neck region of a patient, with at least one of said pull straps positioned on each side of the patient's head;

a plurality of detachable body straps affixed to said draw sheet extending laterally beyond said long sides of said draw sheet, at least one of said body straps positioned near the shoulder region of the patient's torso and at least one draw strap positioned near the hip region of the patient's torso, the distal end of each of said body straps further comprising a fastener for securement around a side bed rail;

whereby one care giver can turn and secure a patient in a side rest position, can retain the patient in a side rest position with both hands free to care for patient needs by securing said fasteners around bed rails, and can detach said draw sheet from said body straps.

2. The draw sheet of claim 1, wherein said openings are semi-circular in shape.

3. The draw sheet of claim 1, wherein said openings are of sufficient size to allow at least a four-finger grasp by a care giver.

4. The draw sheet of claim 1, wherein said pull straps form a loop to receive an elongate rigid member to facilitate longitudinal movement of said draw sheet by a care provider.

5. The draw sheet of claim 4, wherein said loops are opened and closed by means of a fastener.

6. The draw sheet of claim 5, wherein said fasteners associated with said pull straps are hook and loop members.

7. The draw sheet of claim 1, wherein said fasteners are hook and loop members.

8. The draw sheet of claim 1, wherein said fasteners are selected from the group comprising snaps, buttons or ties.

9. The draw sheet of claim 1, wherein said body straps are removably secured to said draw sheet by fasteners.

10. The draw sheet of claim 9, wherein said fasteners for removably securing said body straps to said draw sheet are hook and loop members.

11. The draw sheet of claim 1, further comprising an elongate member disposed in said sleeves along said long edges of said fabric for movement of said draw sheet by a patient care provider.

12. The draw sheet of claim 1 wherein said fabric is a polyester and cotton blend.

13. The draw sheet of claim 1, wherein the lower surface of said draw sheet is a low friction material.

14. The draw sheet of claim 13, wherein said low friction material is selected from the group comprising silk, polyester, polypropylene, nylon or satin.

15. A draw sheet for turning a patient in a bed with side rails, comprising:

a fabric body having a length and a width, the length terminating at a top edge and bottom edge, and the width terminating at a first side and second side;

a sleeve formed along said first side and said second side, at least one opening in said draw sheet disposed proximate each said sleeve;

a plurality of detachable body straps affixed to said draw sheet and extending laterally from said first side to said second side, at least one of said body straps positioned near the shoulder region of the patient's torso and at least one draw strap positioned near the hip region of the patient's torso, said body straps further comprising a fastener for securement around a bed side rail;

whereby one care giver can turn and secure a patient in a side rest position, and can retain the patient in a side rest position by securing at least one of said body straps to the bed side rail, leaving both hands free to care for a patient, and can detach said draw sheet from said body straps to gain greater access to the patient's torso for care and treatment.

16. The draw sheet of claim 15, further comprising a plurality of pull straps extending outwardly from said top edge of said draw sheet, with at least one pull strap positioned on each side of the patient's head.

17. The draw sheet of claim 16, wherein said pull straps form a loop to receive an elongate rigid member to facilitate longitudinal movement of said draw sheet by a care provider.

18. The draw sheet of claim 15, wherein said fasteners are hook and loop members.

19. The draw sheet of claim 15, wherein said body straps are removably secured to said draw sheet by fasteners.

20. The draw sheet of claim 19, wherein said fasteners for securing said body straps to said draw sheet are hook and loop members.

21. The draw sheet of claim 15, further comprising an elongate member disposed in said sleeves along said long edges of said fabric for movement of said draw sheet by a patient care provider.

22. The draw sheet of claim 15, wherein the lower surface of said draw sheet is a low friction material.

23. The draw sheet of claim 22, wherein said material is selected from the group comprising silk, polyester, polypropylene, nylon or satin.

24. The draw sheet of claim 15, further comprising a plurality of pull straps extending outwardly from said bottom edge of said draw sheet.

* * * * *